US008900003B2

(12) United States Patent
Aoki et al.

(10) Patent No.: US 8,900,003 B2
(45) Date of Patent: Dec. 2, 2014

(54) CONNECTOR

(71) Applicant: Yazaki Corporation, Tokyo (JP)

(72) Inventors: Hiroshi Aoki, Aichi (JP); Osamu Oshita, Aichi (JP)

(73) Assignee: Yazaki Corporation, Tokyo (JP)

( * ) Notice: Subject to any disclaimer, the term of this patent is extended or adjusted under 35 U.S.C. 154(b) by 46 days.

(21) Appl. No.: 13/909,926

(22) Filed: Jun. 4, 2013

(65) Prior Publication Data

US 2013/0267107 A1 Oct. 10, 2013

Related U.S. Application Data

(63) Continuation of application No. PCT/JP2011/079652, filed on Dec. 21, 2011.

(30) Foreign Application Priority Data

Dec. 21, 2010 (JP) ..... 2010-285091

(51) Int. Cl.
*H01R 13/62* (2006.01)
*H01R 13/629* (2006.01)
*H01R 13/502* (2006.01)

(52) U.S. Cl.
CPC ..... *H01R 13/629* (2013.01); *H01R 13/502* (2013.01)
USPC ..... 439/372; 439/378

(58) Field of Classification Search
CPC ..... H01R 13/629; H01R 13/502
USPC ..... 439/153, 157, 159, 372, 378
See application file for complete search history.

(56) References Cited

U.S. PATENT DOCUMENTS

| | | | | |
|---|---|---|---|---|
| 6,030,250 | A | 2/2000 | Sawayanagi et al. | |
| 6,855,558 | B1 * | 2/2005 | Hattori | 436/160 |
| 2002/0182918 | A1 | 12/2002 | Okabe et al. | |

FOREIGN PATENT DOCUMENTS

| | | | |
|---|---|---|---|
| JP | 10-125394 | A | 5/1998 |
| JP | 2002-359028 | A | 12/2002 |
| JP | 2003-317867 | A | 7/2003 |

OTHER PUBLICATIONS

International Search Report and Written Opinion of the International Search Report for PCT/JP2011/079652 dated Mar. 13, 2012.

* cited by examiner

*Primary Examiner* — Khiem Nguyen
(74) *Attorney, Agent, or Firm* — Kenealy Vaidya LLP

(57) ABSTRACT

A connector includes a pair of male and female connector housings to be fitted and connected with each other, and one of the pair of male and female connector housings includes a protrusion protruding in the fitting direction such that a distal end thereof is protruded more toward a rear side of other of the pair of male and female connector housings than a rear end of the other connector housing when the one connector housing is positioned at a fitting start position with the other connector housing, and a rod supporting hole as defined herein; the other connector housing includes a raised portion as defined herein and an inclined surface as defined herein; and after the connector housings are positioned at the fitting start positions, the rod-shaped member is pressed from the rod supporting hole onto the inclined surface, thereby fitting and connecting the connector housings.

5 Claims, 14 Drawing Sheets

CONNECTOR

CROSS REFERENCE TO RELATED APPLICATION

This application is a continuation of PCT application No. PCT/JP2011/079652, which was filed on Dec. 21, 2011 based on Japanese Patent Applications No. 2010-285091 filed on Dec. 21, 2010, the contents of which are incorporated herein by reference.

TECHNICAL FIELD

The present invention relates to a connector in which connector housings can be fitted and connected with each other by a low insertion force.

BACKGROUND ART

FIG. 14 shows a typical example of a connector in which connector housings can be fitted and connected with each other by a low insertion force.

A connector 100 shown in FIG. 14 is disclosed in Patent Document 1 below.

The connector 100 is a so-called lever type connector and includes a female connector housing 110 provided at a front end side thereof with a hood portion 111 into which a corresponding connector housing is fitted, a male connector housing 120 male/female-fitted into the hood portion 111, and a lever 130 pivotally mounted on the male connector housing 120.

The lever 130 is pivotally connected to the male connector housing 120 by engaging a middle section in a longitudinal direction (a direction of an arrow X1 in FIG. 14) thereof with a pivoting shaft 121 provided to be protruded from the male connector housing 120. An arrow R1 shown in FIG. 14 indicates a rotation direction of the lever 130 about the pivot shaft 121 as a rotation pivot.

The male connector housing 120 is positioned at a fitting start position with the female connector housing 110 in an inclined state in which an end 131 of the lever 130 is descended toward the female connector housing 110 as shown.

The end 131 of the lever 130 is provided with a protrusion adapted to be engaged with a recess, not shown, provided on the female connector housing 110 when the other end 132 of the lever 130 is pressed down to be rotated about the pivot shaft 121. Also, the other end 132 of the lever 130 is provided with a housing pushing portion for pressing down the male connector housing 120 in a pressing-down direction when the other end is pressed down.

In the connector 100 as described above, when the other end 132 of the lever 130 is pressed down toward the female connector housing 110 after the female connector housing 110 and the male connector housing 120 are positioned at fitting start positions, the lever 130, of which the end 131 has been engaged with the female connector housing 110, serves as a lever member to exert a large pushing force to the male connector housing 120, and as a result, the connector housings can be fitted and connected with each other by a low insertion force.

PRIOR ART DOCUMENT

Patent document

Patent Document 1: JP 2002-359028 A

SUMMARY OF THE INVENTION

Problems to be Solved by the Invention

However, the connector 100, which has the lever 130 used for fitting and connecting the connector housings, has problems, such as increase of the number of components or increase of assembly steps, due to the lever 130.

Also, when the lever 130 is used as a lever member, a magnitude of an insertion force (a pressing-down force) inputted to the lever 130 is determined by a leverage ratio. To reduce the insertion force, it is effective to increase a length dimension of the lever 130, thereby increasing the leverage ratio.

However, if the length dimension of the lever 130 is increased to reduce the insertion force, there is a problem in that the size of the connector is increased.

Accordingly, the present invention has been made to solve the above problems, and an object of the invention is to provide a connector which does not cause increase of the number of components or increase of assembly steps, allows connector housings to be fitted and connected with each other by an insertion force as low as or even lower than that of a lever type connector, and also is suited for downsizing thereof.

Means for Solving the Problems

The above object of the present invention is achieved by the following configurations.

(1) A connector comprising a pair of male and female connector housings to be fitted and connected with each other, wherein one connector housing of the pair of male and female connector housings comprises a protrusion protruding in a fitting direction between the connector housings such that a distal end thereof is protruded more toward a rear side of other connector housing of the pair of male and female connector housings than a rear end of the other connector housing when the one connector housing is positioned at a fitting start position with the other connector housing, and a rod supporting hole formed through the distal end of the protrusion to allow a rod-shaped member, which is a separate member, to be inserted therethrough in a direction intersecting with the fitting direction between the connector housings;

wherein the other connector housing comprises a raised portion disposed at a position opposed to the rod supporting hole in a direction approximately perpendicular to the fitting direction between the connector housings and raised from the rear end of the other connector housing to extend in the direction approximately perpendicular to the fitting direction between the connector housings, when the other connector housing is positioned at a fitting start position with the one connector housing, and an inclined surface formed on the raised portion to allow a distal end of the rod-shaped member inserted through the rod supporting hole to be contacted therewith and adapted to convert an axial load acting on the rod-shaped member to a load in a direction in which the other connector housing is pressed into the one connector housing; and wherein after the connector housings are positioned at the fitting start positions, the rod-shaped member is pressed from the rod supporting hole onto the inclined surface, thereby fitting and connecting the connector housings.

(2) The connector according to (1), wherein the protrusion is provided to be inserted through a protrusion inserting through-hole formed through the substantial center of the other connector housing so as to be protruded toward the rear end of the other connector housing.

(3) The connector according to (1) or (2), wherein a recess adapted to allow the distal end of the rod-shaped member to be inserted (engaged) therein in the direction intersecting with the fitting direction between the connector housings is provided on an outer surface of the raised portion which does not face the protrusion;

a separating contact surface adapted to allow an outer surface of a middle section of the rod-shaped member, of which the distal end has been inserted in the recess, to be contacted therewith is provided at a position of the one connector housing opposed to the recess in a fitted and connected state of the connector housings; and in the fitted and connected state of the connector housings, when a base end-side of the rod-shaped member, of which the distal end has been inserted in the recess and the outer surface of the middle section has been contacted with the separating contact surface, is pressed down, the fitting between the connector housings is released.

(4) The connector according to (1) or (2), wherein each of the rod supporting hole and the inclined surface is formed to allow a driver, which is a general purpose tool, to be used as the rod-shaped member.

(5) The connector according to (3), wherein each of the rod supporting hole, the inclined surface, the recess and the separating contact surface is formed to allow a driver, which is a general purpose tool, to be used as the rod-shaped member.

According to the configuration of (1), when the rod-shaped member is inserted from the rod supporting hole onto the inclined surface after the connector housings are positioned at the fitting start positions, the inclined surface contacted with the distal end of the rod-shaped member is subjected to a load in a direction, in which the inclined surface is pressed, converted from an axial load acting on the rod-shaped member. At the same time, as a reaction, the protrusion is subjected to a load in a direction in which the protrusion is lifted. By the loads acting on the inclined surface and the protrusion, the connector housings can be fitted and connected with each other.

Also, by gently setting the inclination of the inclined surface relative to an inserting direction of the rod-shaped member, an inserting operation force of the rod-shaped member can become lower, and like a lever type connector, an operation force upon fitting and connecting the connector housings can become lower.

Further, the rod-shaped member is a separate member from each of the connector housings constituting the connector and can be handled and utilized as a separate tool, and thus, unlike a lever which is previously mounted on a connector housing, increase of assembly steps is not caused. In addition, because the rod-shaped member can be handled as a separate tool from each of the connector housings, or the like, even if the rod-shaped member has a length or thickness allowing easy manipulation, downsizing of the connector can be achieved without increasing in the size of the connector.

Therefore, increase of assembly steps is not caused, the connector housings can be fitted and connected with each other by an insertion force as low as or even lower than that of the lever type connector, and also downsizing thereof can be achieved.

According to the configuration of (2), because the protrusion is inserted through the substantial center of the other connector housing, a load in a fitting direction, which acts from the rod-shaped member through the protrusion on the one connector housing, acts on the substantial center of the one connector housing corresponding to the installation position of the protrusion, during fitting and connecting operation between the connector housings in which the rod-shaped member is inserted from the rod supporting hole of the protrusion onto the inclined surface.

As a result, inclination or twisting caused in the one connector housing can be inhibited, thereby providing a smooth fitting between the connector housings.

According to the configuration of (3), in a state in which the fitting connection between the connector housings has been completed, the rod-shaped member, of which the distal end has been inserted in the recess and also the outer surface of the middle section has been contacted with the separating contact surface, can serve as a lever for releasing the fitting between the connector housings when the base end-side thereof is pressed down, and as a result, like the lever type connector, an operation force upon separation between the connector housings can become lower.

According to the configuration of (4) or (5), a driver which is a general purpose tool can be used as the rod-shaped member, and thus preparation of a dedicated rod-shaped member can be not required, thereby preventing increase of the number of components of the connector.

EMBODIMENTS FOR CARRYING OUT THE INVENTION

An exemplary embodiment of a connector according to the present invention will be now described in detail with reference to the accompanying drawings.

Figure 1:
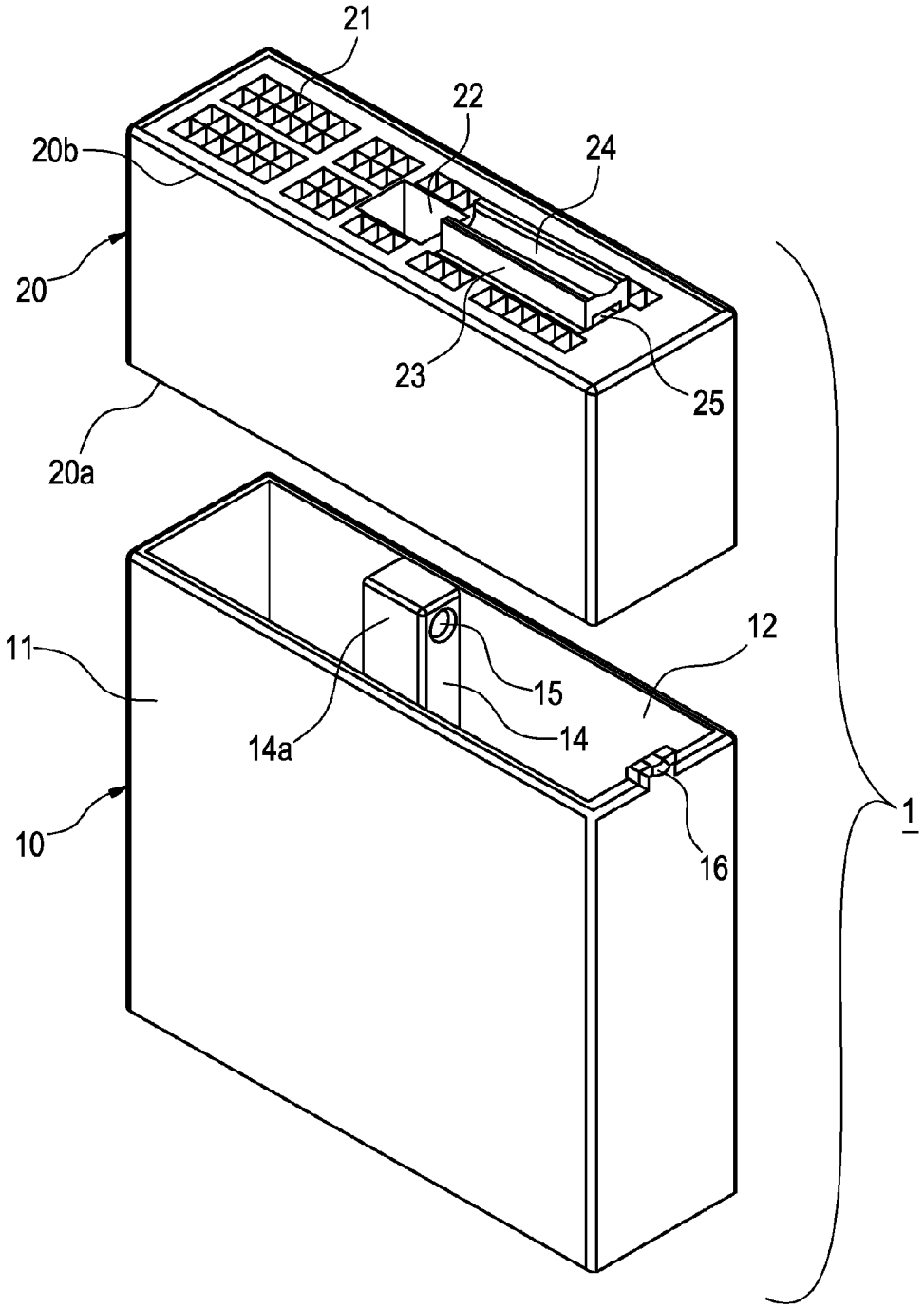
FIG. 1 is an exploded perspective view of an embodiment of a connector according to the present invention.

As shown in FIG. 1, the connector 1 according of the embodiment includes a male connector housing 10 provided at a front end thereof with a hood portion 11 of a generally rectangular cylindrical shape onto which a corresponding connector housing is fitted, and a female connector housing 20 male/female-fitted onto the male connector housing 10.

The female connector housing 20 is fitted and connected into the male connector 10 by inserting a front end 20*a* thereof into the hood portion 11 up to a predetermined depth.

Figure 2:
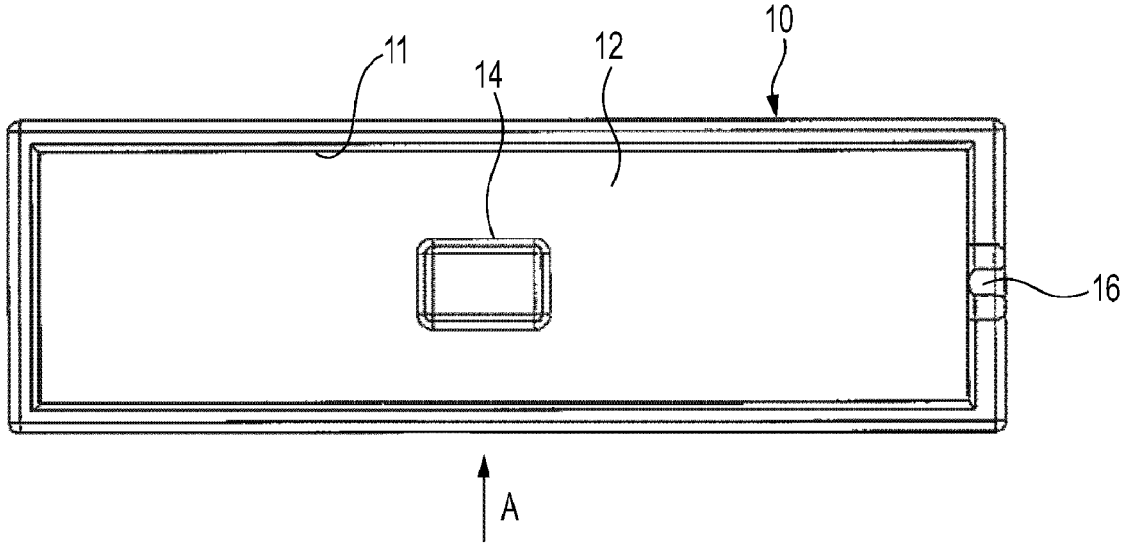
FIG. 2 is a front (front end) view of a male connector housing shown in FIG. 1.
Figure 3:
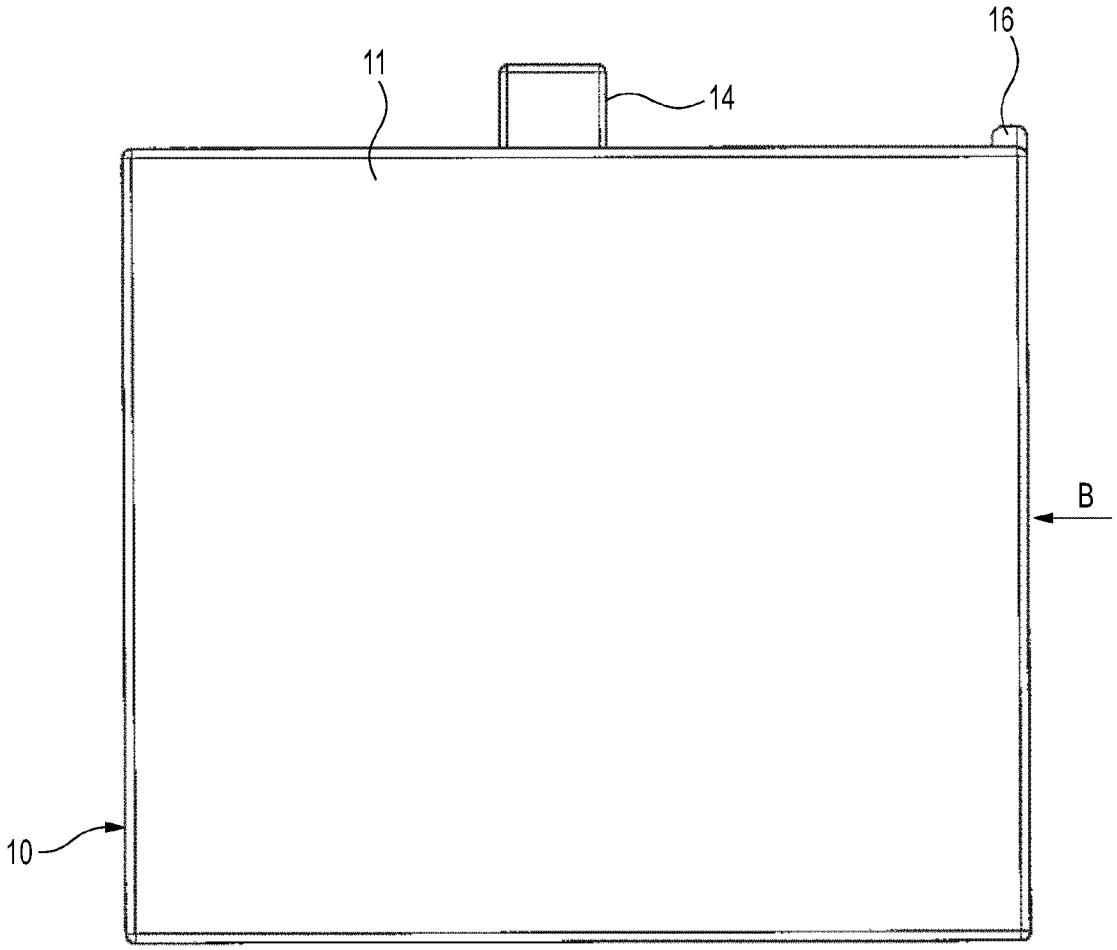
FIG. 3 is a view as viewed in a direction of an arrow A in FIG. 2.
Figure 4:
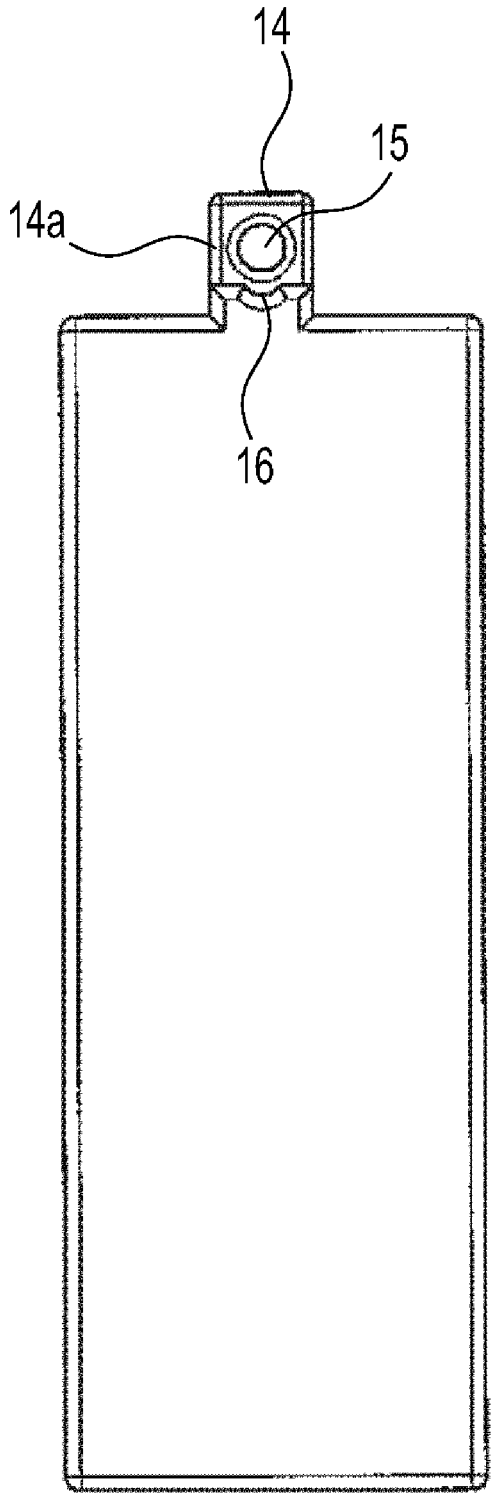
FIG. 4 is a view as viewed in a direction of an arrow B in FIG. 3.

According to the present embodiment, the male connector 10 corresponding to one connector housing of a pair of male and female connector housings 10 and 20, as shown in FIGS. 2 to 4, includes a male terminal receiving portion 12, a protrusion 14, a rod supporting hole 15, and a separating contact surface 16.

The male terminal receiving portion 12 has a configuration in which a plurality of terminal receiving holes for receiving male terminal fittings not shown are arranged in an array, and is adapted to receive and hold a plurality of male terminal fittings. The male terminal receiving portion 12 is provided on a rear end side (an inner part of the hood portion 11) which is a side opposite to the hood portion 11.

Figure 8:
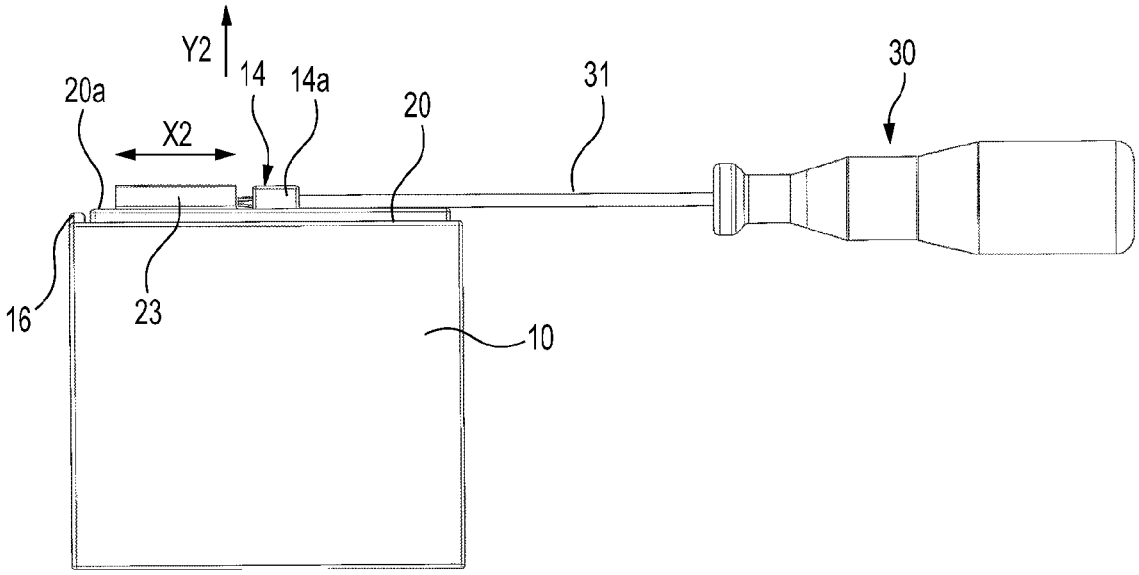
FIG. 8 is a side view showing a state in which, after the connector housings are positioned at fitting start positions with each other, a distal end of a shaft portion of a driver has been inserted in a rod supporting hole of a protrusion of the male connector housing.

As shown in FIGS. 1 to 3, the protrusion 14 has a generally prismatic shape and is provided to be protruded along a fitting direction of the male and female connectors 10 and 20. Also, the protrusion 14 is provided to be vertically erected at the substantial center of the male terminal receiving portion 12 of the male connector housing 10. In addition, as shown in FIG. 8, a protruded length of the protrusion 14 is set such that a distal end 14*a* thereof is protruded more toward a rear side (a direction of an arrow Y2 in FIG. 8) of the female connector housing 20 than a rear end 20*b* of the female connector housing 20, when the front end 20*a* of the female connector housing 20 is inserted in the hood portion 11 of the male connector 10 so that the male connector housing 10 is positioned at a fitting start position with the female connector housing 20.

As shown in FIGS. 1 to 4, the rod supporting hole 15 is a hole formed through the distal end 14*a* of the protrusion 14 to allow a shaft portion 31 of a driver 30 (see FIG. 8) as a rod-shaped member, which is a separate member from the male and female connector housings 10 and 20, to be inserted therein in a direction intersecting with a fitting direction between the connector housings.

A hole diameter of the rod supporting hole 15 is set slightly larger than an outer diameter of the shaft portion 31, so that the shaft portion 31 of the driver 30 can be removed or inserted without any resistance.

Figure 12:
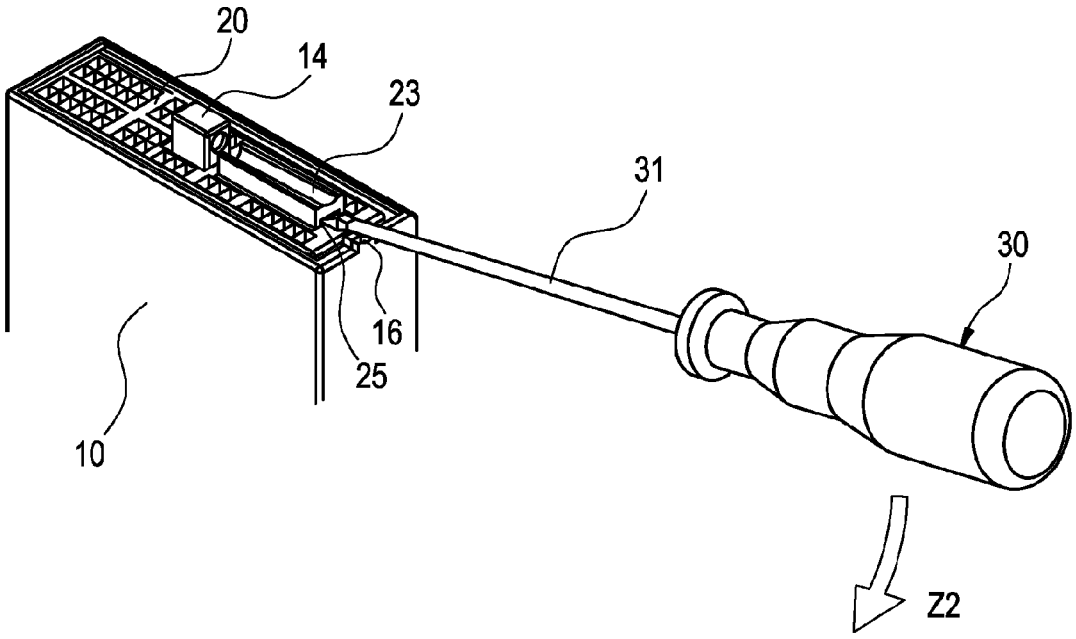
FIG. 12 is a perspective view showing a method for separating the connector housings in the fitted and connected state from each other.

As shown in FIGS. 2 to 4, the separating contact surface 16 is provided on a distal end of the hood portion 11 opposed to the rod supporting hole 15 of the protrusion 14. An installation position of the separating contact surface 16 is a position opposed to a recess 25 of the female connector housing 20 as described below. As shown in FIG. 12, the separating contact surface 16 is a surface being capable of contacting with an outer surface of a middle section of the shaft portion 31 of the driver 30, of which a distal end has been inserted in the recess 25 of the female connector housing 20 in a fitted and connected state of the male and female connector housings 10 and 20. The separating contact surface 16 is formed in a groove shape adapted such that it is difficult for the shaft portion 31 to be deviated in a direction perpendicular to an axis thereof.

As shown in FIGS. 1 and 5 to 7, the female connector 20, which is the other connector housing of a pair of male and female connector housings 10 and 20, includes a female terminal receiving portion 21, a protrusion inserting through-hole 22, a raised portion 23, an inclined surface, and the recess 25.

Figure 5:
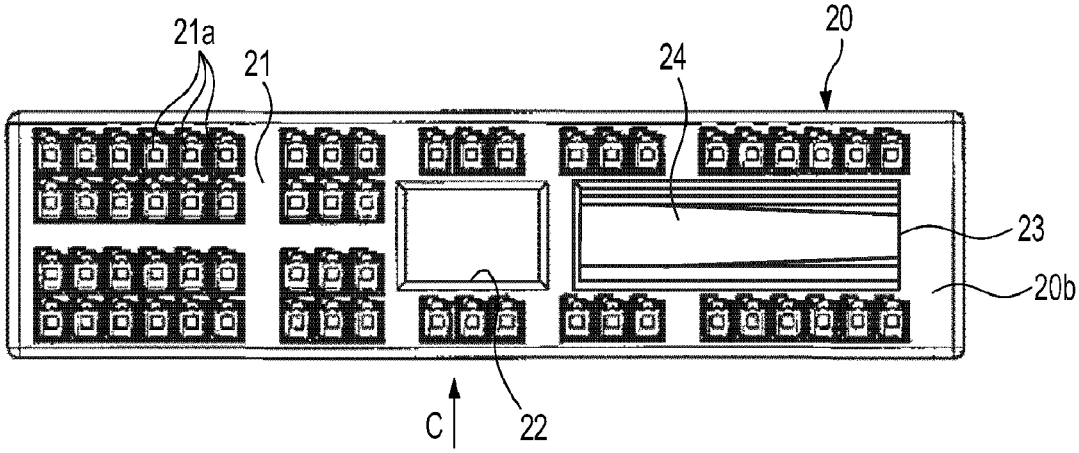
FIG. 5 is a rear view of a female connector housing shown in FIG. 1.
Figure 6:
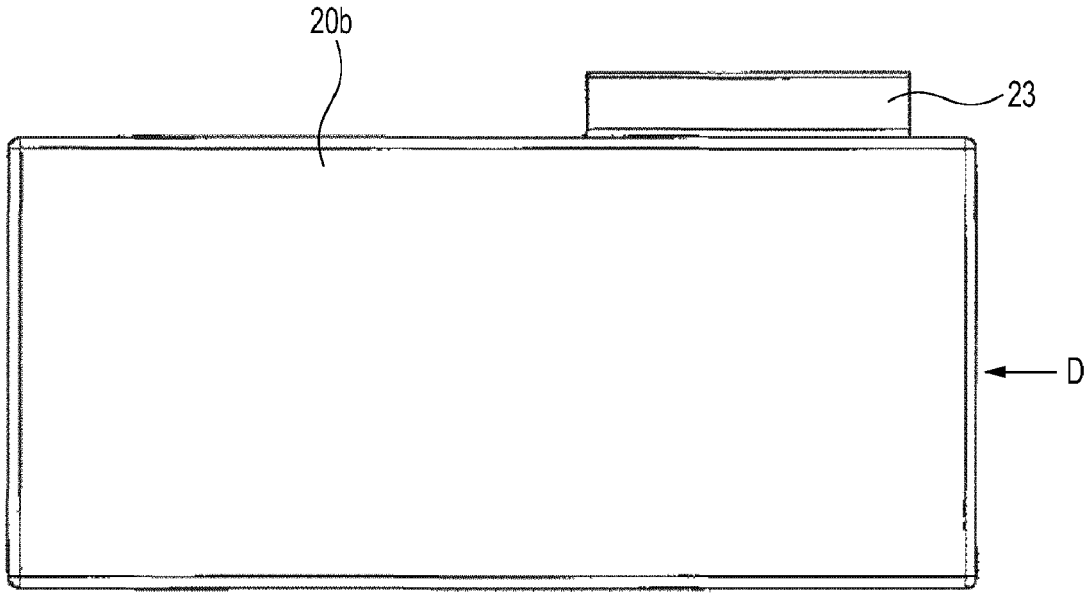
FIG. 6 is a view as viewed in a direction of an arrow C in FIG. 5.

As shown in FIG. 5, the female terminal receiving portion 21 is a configuration in which a plurality of terminal receiving holes 21*a* for receiving female terminal fittings are arranged in an array, and is adapted to receive and hold a plurality of male terminal fittings.

The protrusion inserting through-hole 22 is a hole adapted to allow the protrusion 14 of the male connector housing 10 to be inserted therethrough, and is formed through the center of the female connector 20, correspondingly to the installation position of the protrusion 14 in the male connector housing 10.

Figure 9:
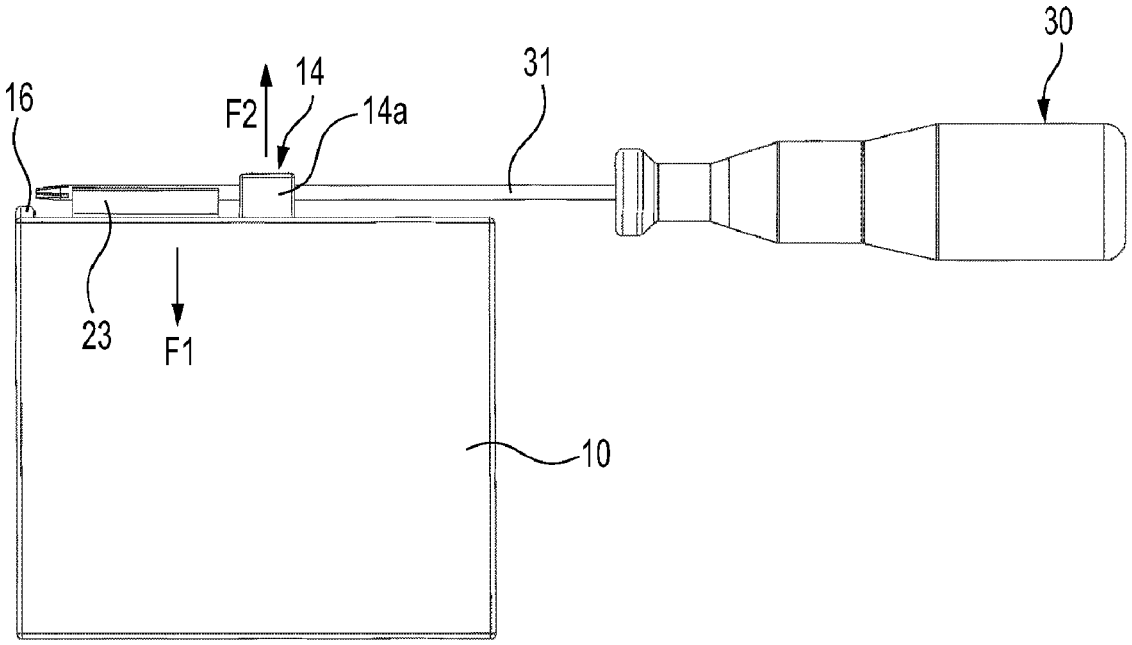
FIG. 9 is a side view showing a state in which the distal end of the shaft portion of the driver has been further pressed onto an inclined surface of the female connector housing from the state of FIG. 8, so that the connector housings are fitted and connected with each other.

As shown in FIGS. 8 and 9, when the male connector housing 10 and the female connector housing 20 have been positioned at the fitting start positions, the protrusion 14 of the male connector housing 10 is extended through the protrusion inserting through-hole 22 of the female connector housing 20 so that the distal end 14*a* of the protrusion 14 protrudes to the rear end side of the female connector housing 20.

As shown in FIG. 1, the raised portion 23 is provided at a position adjacent to the protrusion inserting through-hole 22 in a shape raised toward the rear side. More specifically, the raised portion 23, as shown in FIGS. 8 and 9, is provided at a position opposed to the rod supporting hole 15 when the female connector housing 20 has been positioned at the fitting start position with the male connector housing 10. In addition, as shown in FIGS. 8 and 9, the raised portion 23 is raised from the rear end of the female connector housing 20 to be approximately perpendicular to the fitting direction between the connector housings and also to extend in a direction (a direction of an arrow X2 in FIG. 8) opposed to the rod supporting hole 15.

The inclined surface 24 is formed on the raised portion 23 to contact with the shaft portion 31 of the driver 30 inserted through the rod supporting hole 15. Also, the inclined surface 24 is formed by a surface inclined upward in a direction away from the protrusion 14, such that an axial load acted on the shaft portion 31 of the driver 30 is converted to a load in a direction in which the female connector housing 20 is pressed in the male connector housing 10.

According to the present embodiment, the inclined surface 24 is formed in a groove shape adapted such that it is difficult for the shaft portion 31 to be deviated in a direction perpendicular to the axis thereof.

Figure 7:
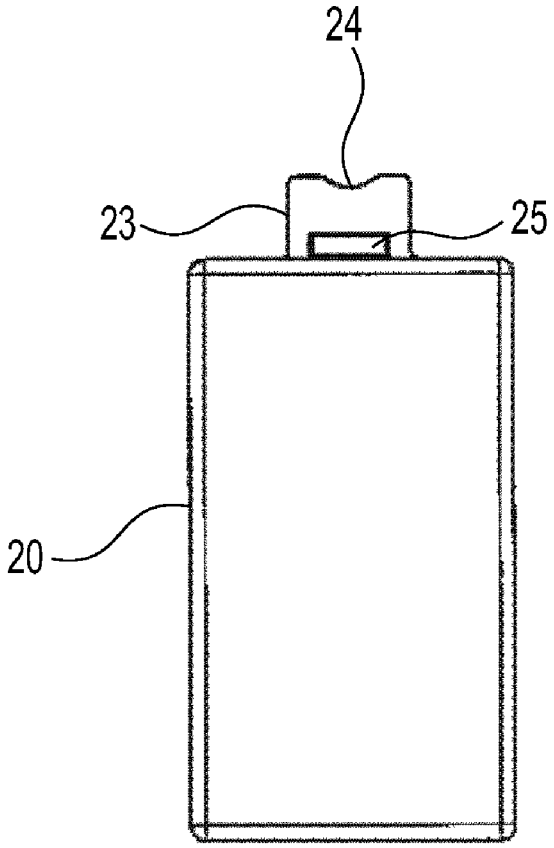
FIG. 7 is a view as viewed in a direction of an arrow B in FIG. 6.

As shown in FIGS. 1 and 7, the recess 25 is a portion recessed to allow the distal end of the shaft portion 31 of the driver 30 to be inserted (engaged) therein in a direction intersecting (approximately perpendicular to) with the fitting direction between the male and female connector housings 10 and 20. The recess 25 is formed in an outer surface of the raised portion 23 which does not face the rod supporting hole 15 and is opposed to the separating contact surface 16. Also, the recess 25 is disposed lower than the inclined surface 24.

Hereinafter, a method of fitting and connecting the male connector housing 10 and the female connector housing 20 and a method of separating the male connector housing 10 and the female connector housing 20 which have been fitted and connected with each other will be described in this order.

Figure 10:
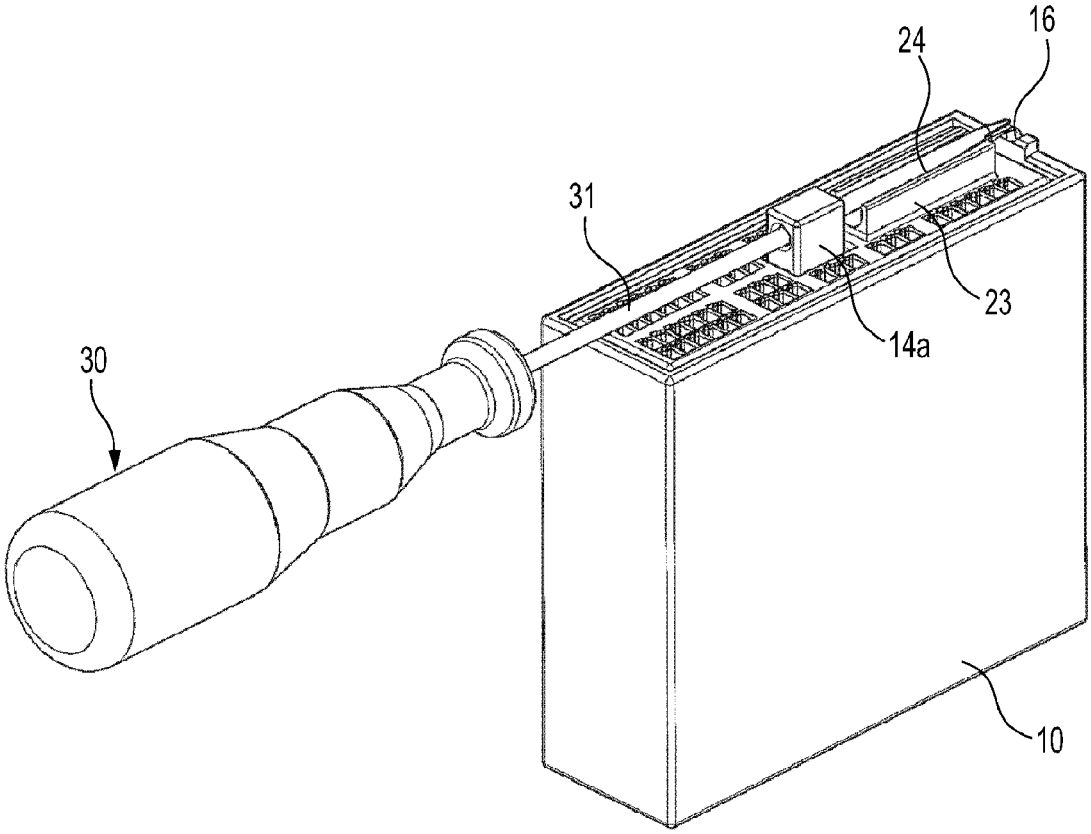
FIG. 10 is a perspective view of the fitted and connected state shown in FIG. 9.

Firstly, the method of fitting and connecting the male and female connector housings with each other will be described on the basis of FIGS. 8 to 10.

First, as shown in FIG. 8, after the male connector housing 10 and the female connector housing 20 are positioned at the fitting start positions, the shaft portion 31 of the driver 30 is pressed from the rod supporting hole 15 onto the inclined surface 24. As shown in FIG. 9, when the shaft portion 31 extended through the rod supporting hole 15 is ridden on the inclined surface 24 on the raised portion 23, the inclined surface 24 contacted with the distal end of the shaft portion 31 is subjected to a load F1 in a direction, in which the inclined surface 24 is pressed, converted from an axial load acting on the driver 30. At the same time, as a reaction, the protrusion 14 is also subjected to a load F2 in a direction in which the protrusion 14 is lifted. By the loads F1 and F2 acting on the inclined surface 24 and the protrusion 14, the connector housings can be fitted and connected with each other.

Figure 11:
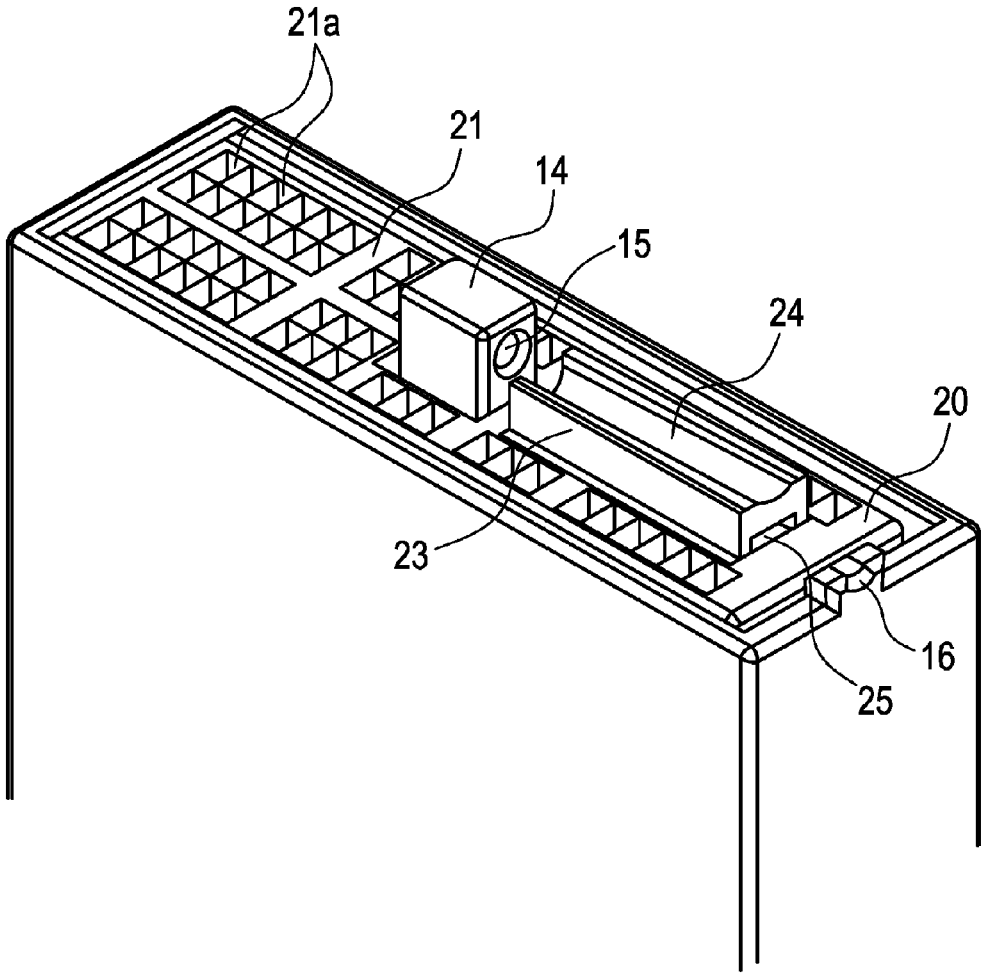
FIG. 11 is a perspective view showing a state in which the fitting between the connector housings shown in FIG. 1 has been completed.

As shown in FIG. 9, when the distal end of the shaft portion 31 has been protruded from an end surface of the inclined surface 24, the fitting connection between the male and female connector housings 10 and 20 is completed. FIG. 11 shows a state in which the fitting connection between the male and female connector housings 10 and 20 has been completed.

Namely, according to the connector 1 of the present embodiment, the male and female connector housings 10 and 20 are fitted and connected with each other by pressing the shaft portion 31 of the driver 30 from the rod supporting hole 15 onto the inclined surface 24 after the male and female connector housings 10 and 20 are positioned at the fitting start positions.

Next, the method of separating the male and female connector housings 10 and 20 from the fitted state will be described on the basis of FIGS. 12 and 13.

Figure 13:
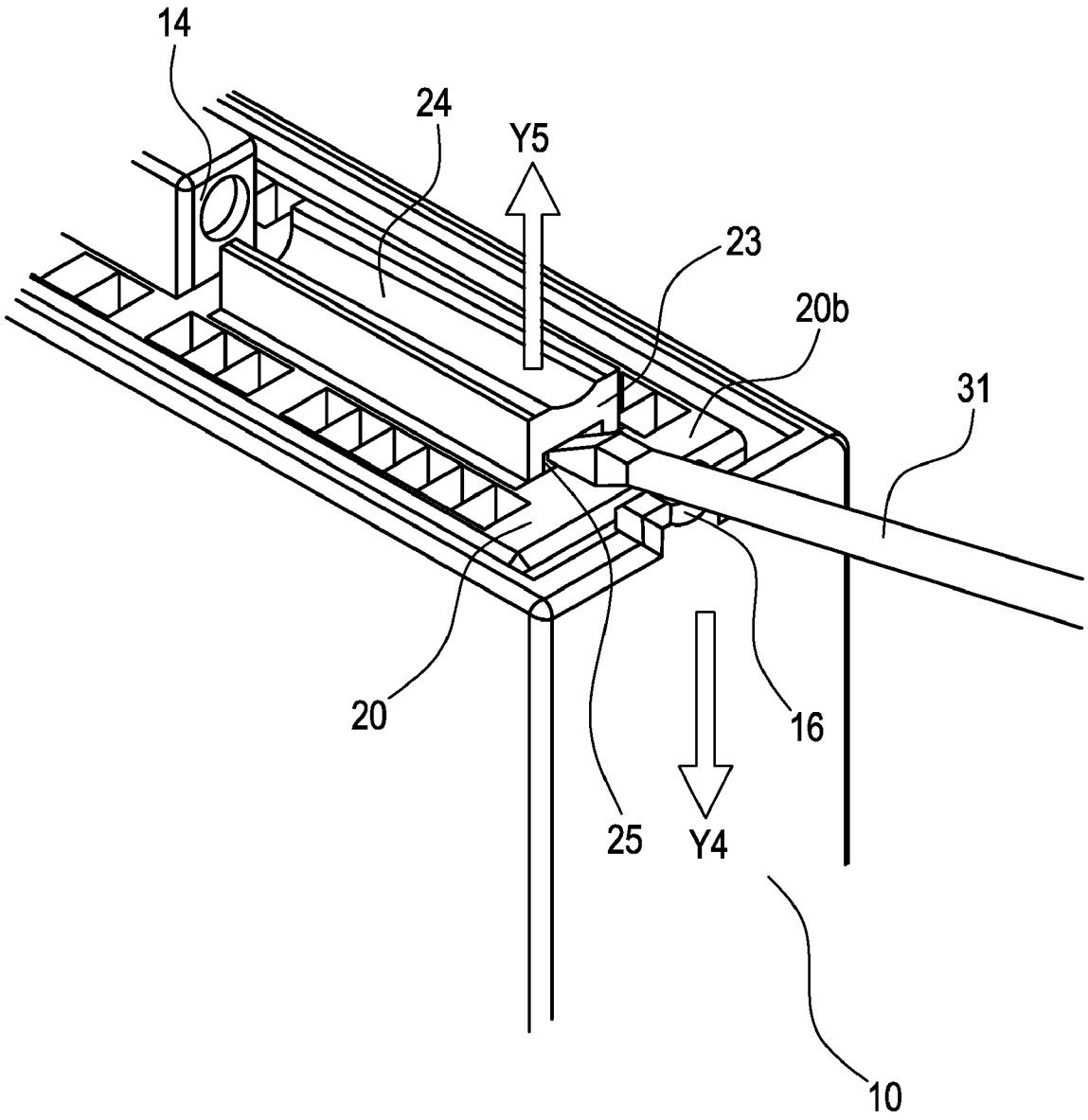
FIG. 13 is an enlarged view of a main part of FIG. 12.
Figure 14:
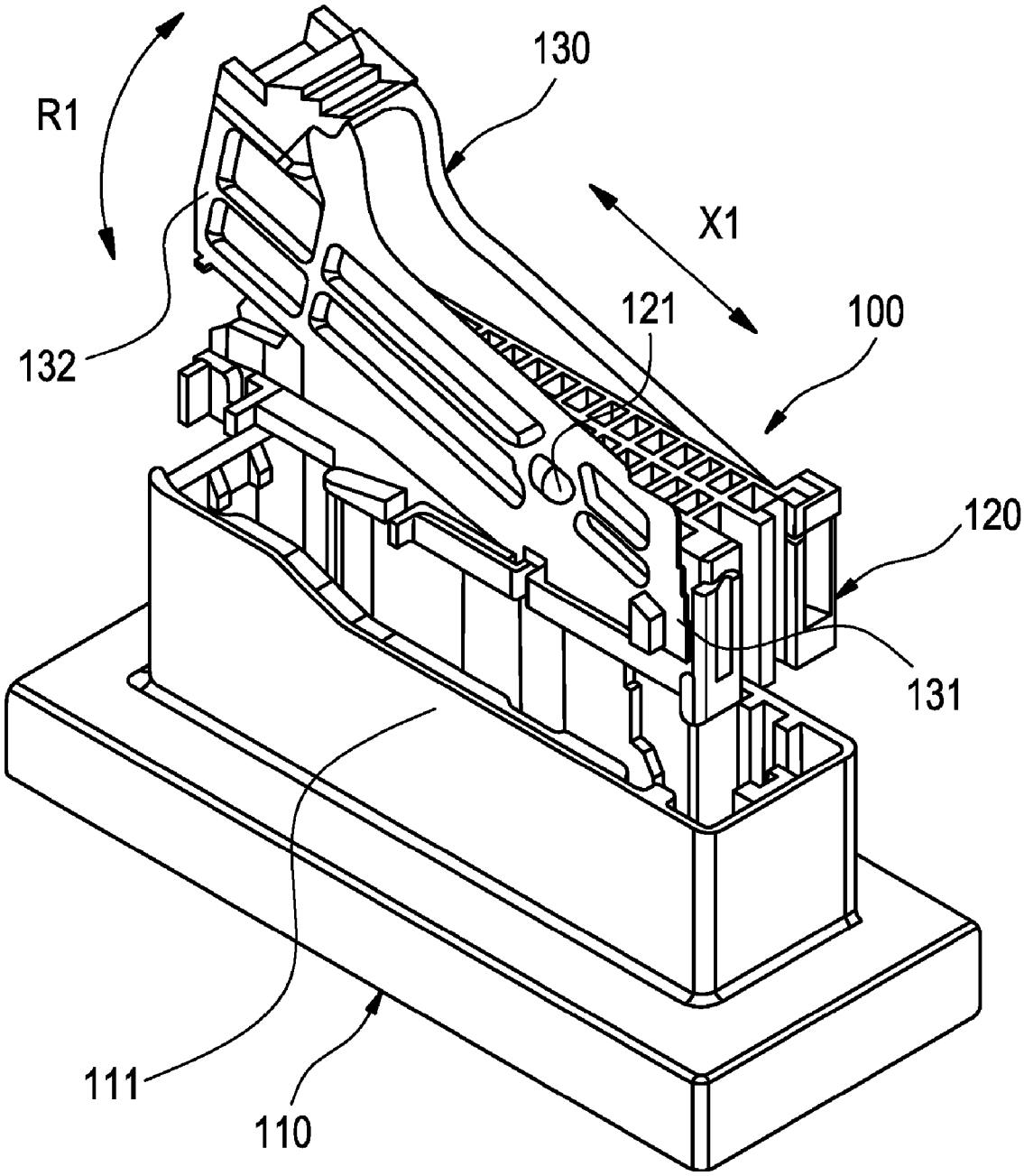
FIG. 14 is an explanatory view of a typical low insertion force connector.

In this case, as shown in FIGS. 12 and 13, in a state in which the connecter housings has been fitted and connected with each other, the distal end of the shaft portion 31 of the driver 30 is inserted in the recess 25 and at the same time, the outer surface of the middle section of the shaft portion 31 is contacted with the separating contact surface 16. Then, as indicated by an arrow Z2 in FIG. 12, a base end-side of the driver 30 is pushed down.

Then, as shown in FIG. 13, by pressing down the driver 30, the separating contact surface 16 is subjected to a downward pressing-down load as indicated by an arrow Y4 and the raised portion 23 is subjected to an upward lifting load as indicated by an arrow Y5, so that the male and female connector housings 10 and 20 are moved in a direction separated from each other and thus separation between the male and female connector housings 10 and 20 is performed.

Namely, according to the connector 1 of the present embodiment, in a state in which the male and female connector housings 10 and 20 have been fitted and connected with each other, the base end-side of the driver 30, of which the distal end has been inserted in the recess 25 and also the outer surface of the middle section has been contacted with the separating contact surface 16, is pressed down, thereby releasing the fitting between the male and female connector housings 10 and 20.

In the connector 1 according to the present embodiment as described above, when the shaft portion 31 of the driver 30 is inserted from the rod supporting hole 15 onto the inclined surface 24 after the male and female connector housings 10 and 20 are positioned at the fitting start positions, an axial load acting on the driver 30 is converted to a load in a direction in which the male and female connector housings 10 and 20 are fitted with each other, thereby acting on the protrusion 14 and the raised portion 23 and hence fitting and connecting the male and female connector housings 10 and 20 with each other.

Also, by gently setting the inclination of the inclined surface 24 relative to an inserting direction of the shaft portion 31 of the driver 30, an inserting operation force of the driver 30 can become lower, and like a lever type connector, an operation force upon fitting and connecting the connector housings with each other can become lower.

Further, the driver 30 is a separate member from each of the male and female connector housings 10 and 20 constituting the connector 1 and can be handled and utilized as a separate tool, and thus, unlike a lever which is previously mounted on a connector housing, increase of assembly steps is not caused.

In addition, because the driver 30 can be handled as a separate tool from each of the male and female connector housings 10 and 20, or the like, even if the driver 30 has a length or thickness allowing easy manipulation, downsizing of the connector 1 can be achieved without increasing in the size of the connector 1.

Therefore, increase of assembly steps is not caused, the male and female connector housings 10 and 20 can be fitted and connected with each other by an insertion force as low as or even lower than that of the lever type connector, and also downsizing thereof can be achieved.

Also, in the connector 1 according to the present embodiment as described above, because the protrusion 14 is inserted through the substantial center of the female connector housing 20, a load in a fitting direction, which acts from the shaft portion 31 through the protrusion 14 on the male connector housing 10, acts on the substantial center of the male connector housing 10 corresponding to the installation position of the protrusion 14, during fitting and connecting operation in which the shaft portion 31 of the driver 30 is inserted from the rod supporting hole 15 of the protrusion 14 onto the inclined surface 24.

As a result, inclination or twisting caused in the male connector housing 10 can be inhibited, thereby providing a smooth fitting between the male and female connector housings 10 and 20.

Further, in the connector 1 according to the present embodiment as described above, in a state in which the fitting connection between the male and female connector housings 10 and 20 has been completed, the driver 30, of which the distal end has been inserted in the recess 25 and also the outer surface of the middle section has been contacted with the separating contact surface 16, can serve as a lever for releasing the fitting between the male and female connector housings 10 and 20 when the base end-side thereof is pressed down, and as a result, like the lever type connector, an operation force upon separation between the male and female connector housings 10 and 20 can become lower.

In addition, in the connector 1 according to the present embodiment as described above, the drive which is a general purpose tool can be used as the rod-shaped member, and thus preparation of a dedicated rod-shaped member can be not required, thereby preventing increase of the number of components of the connector 1.

Meanwhile, the connector 1 of the present invention is not limited to the foregoing embodiment, and appropriate changes, modifications or the like thereof can be made.

For example, in the foregoing embodiment, although the male connector housing 10 is provided with the protrusion 14 and the female connector housing 20 is provided with the raised portion 23, contrarily, the female connector housing 20 may be provided with the protrusion 14 extending through the male connector housing 10, and the male connector housing 10 may be provided on a rear end side thereof with the raised portion 23.

Also, in the present embodiment, although the drive 30 which is a general purpose tool is used as the rod-shaped member, a dedicated rod-shaped member corresponding to the shaft portion 31 of the driver 30 may be prepared.

In addition, shape, dimension, installation location and the like of the protrusion 14, the raised portion 23, the separating contact surface 16 or the like exemplified in the foregoing embodiment are not limited to the embodiment but arbitrary if the object of the present invention can be achieved.

INDUSTRIAL APPLICABILITY

According to the connector of the present invention, increase of the number of components or increase of assembly steps is not caused, connector housings can be fitted and connected with each other by an insertion force as low as or even lower than that of a lever type connector, and also downsizing of the connector can be achieved.

DESCRIPTION OF THE SYMBOLS

1 Connector
10 Male connector housing (One connector housing)
14 Protrusion
14*a* Distal end
15 Rod supporting hole
16 Separating contact surface
20 Female connector housing (other connector housing)
20*b* Rear end
22 Protrusion inserting through-hole
23 Raised portion
24 Inclined surface
25 Recess
30 Driver
31 Shaft portion (Rod-shaped member)

The invention claimed is:

1. A connector comprising a pair of male and female connector housings to be fitted and connected with each other, wherein one connector housing of the pair of male and female connector housings comprises a protrusion protruding in a fitting direction between the connector housings such that a distal end thereof is protruded more toward a rear side of other connector housing of the pair of male and female connector housings than a rear end of the other connector housing when the one connector housing is positioned at a fitting start position with the other connector housing, and a rod supporting hole formed through the distal end of the protrusion to allow a rod-shaped member, which is a separate member, to be inserted therethrough in a direction intersecting with the fitting direction between the connector housings;

the other connector housing comprises a raised portion disposed at a position opposed to the rod supporting hole in a direction approximately perpendicular to the fitting direction between the connector housings and raised from the rear end of the other connector housing to extend in the direction approximately perpendicular to the fitting direction between the connector housings, when the other connector housing is positioned at a fitting start position with the one connector housing, and an inclined surface formed on the raised portion to allow a distal end of the rod-shaped member inserted through the rod supporting hole to be contacted therewith and adapted to convert an axial load acting on the rod-shaped member to a load in a direction in which the other connector housing is pressed into the one connector housing; and after the connector housings are positioned at the fitting start positions, the rod-shaped member is pressed from the rod supporting hole onto the inclined surface, thereby fitting and connecting the connector housings.

2. The connector according to claim 1, wherein the protrusion is provided to be inserted through a protrusion inserting through-hole formed through a substantial center of the other connector housing so as to be protruded toward the rear end of the other connector housing.

3. The connector according to claim 1, wherein a recess adapted to allow the distal end of the rod-shaped member to be inserted therein in the direction intersecting with the fitting direction between the connector housings is provided on an outer surface of the raised portion which does not face the protrusion;

a separating contact surface adapted to allow an outer surface of a middle section of the rod-shaped member, of which the distal end has been inserted in the recess, to be contacted therewith is provided at a position of the one connector housing opposed to the recess in a fitted and connected state of the connector housings; and in the fitted and connected state of the connector housings, when a base end-side of the rod-shaped member, of which the distal end has been inserted in the recess and the outer surface of the middle section has been contacted with the separating contact surface, is pressed down, the fitting between the connector housings is released.

4. The connector according to claim 1, wherein each of the rod supporting hole and the inclined surface is formed to allow a driver, which is a general purpose tool, to be used as the rod-shaped member.

5. The connector according to claim 3, wherein each of the rod supporting hole, the inclined surface, the recess and the separating contact surface is formed to allow a driver, which is a general purpose tool, to be used as the rod-shaped member.

* * * * *